US007926197B2

(12) United States Patent
Zoppas et al.

(10) Patent No.: US 7,926,197 B2
(45) Date of Patent: Apr. 19, 2011

(54) PROCESS AND DEVICE FOR TREATING THE COATING OF THERMOPLASTIC RESIN CONTAINERS

(75) Inventors: Matteo Zoppas, Fontanafredda (IT); Alberto Armellin, Vittorio Veneto (IT); Andrea Saran, Borgo S. Antonio (IT); Ottorino Vendramelli, San Vendemiano (IT)

(73) Assignee: S.I.P.A. Societa Industrializzazione Progettazione e Automazione S.p.A. (IT)

( * ) Notice: Subject to any disclaimer, the term of this patent is extended or adjusted under 35 U.S.C. 154(b) by 1417 days.

(21) Appl. No.: 10/527,225

(22) PCT Filed: Sep. 10, 2003

(86) PCT No.: PCT/EP03/10040

§ 371 (c)(1),
(2), (4) Date: Mar. 10, 2005

(87) PCT Pub. No.: WO2004/024346

PCT Pub. Date: Mar. 25, 2004

(65) Prior Publication Data

US 2006/0040063 A1 Feb. 23, 2006

(30) Foreign Application Priority Data

Sep. 10, 2002 (IT) ..... RM02A0452

(51) Int. Cl.
*F26B 13/00* (2006.01)

(52) U.S. Cl. ..... 34/90; 34/610; 34/614; 34/619; 427/393; 432/170; 126/110 C; 60/39.5

(58) Field of Classification Search ..... 34/90, 610, 34/61, 4, 619; 432/170; 126/110 C; 60/39.5; 427/393

See application file for complete search history.

(56) References Cited

U.S. PATENT DOCUMENTS

| | | | | | |
|---|---|---|---|---|---|
| 1,445,093 | A | * | 2/1923 | Lindahl | 34/565 |
| 1,551,305 | A | * | 8/1925 | Hellman | 34/69 |
| 1,774,161 | A | | 8/1930 | Wetmore | |
| 2,463,570 | A | * | 3/1949 | Speicher | 34/68 |
| 2,515,098 | A | * | 7/1950 | Smith, Jr. | 34/290 |
| 2,742,708 | A | * | 4/1956 | McCormick | 34/76 |
| 3,060,057 | A | * | 10/1962 | Johnson | 427/557 |
| 3,078,589 | A | * | 2/1963 | Carlson | 34/77 |
| 3,145,092 | A | * | 8/1964 | Decker et al. | 65/351 |
| 3,182,589 | A | * | 5/1965 | Green et al. | 101/40 |
| 3,253,943 | A | * | 5/1966 | Mayer et al. | 427/235 |
| 3,543,412 | A | * | 12/1970 | Price | 34/99 |
| 3,566,575 | A | * | 3/1971 | Lisiecki | 53/426 |
| 3,643,626 | A | * | 2/1972 | McKay et al. | 118/58 |
| 3,711,961 | A | * | 1/1973 | Spiegel et al. | 34/218 |
| 3,724,090 | A | * | 4/1973 | Smith, Jr. | 34/593 |

(Continued)

FOREIGN PATENT DOCUMENTS

GB 936147 9/1963

(Continued)

*Primary Examiner* — Stephen M. Gravini
(74) *Attorney, Agent, or Firm* — Lorusso & Associates

(57) ABSTRACT

A process and device for drying the coating of containers made of thermoplastic material. The process involves feeding said containers through a furnace divided into two areas: in the first, most of the solvent of the coating is removed by heating the paint with infrared lamps, while the temperature of the containers is controlled through an airflow; in the second, the remaining solvent is removed using said airflow coming from the first area of the furnace.

3 Claims, 2 Drawing Sheets

U.S. PATENT DOCUMENTS 3,734,765 A * 5/1973 Russell ..... 427/407.2
3,859,774 A * 1/1975 Bausch ..... 53/167
3,934,993 A * 1/1976 Bowman et al. ..... 65/60.1
4,009,298 A * 2/1977 Cavanagh ..... 427/521
4,009,301 A * 2/1977 Heckman et al. ..... 427/195
4,017,982 A * 4/1977 Goffredo ..... 34/464
4,050,407 A * 9/1977 Garwood et al. ..... 118/58
4,064,639 A * 12/1977 Pels-Leusden et al. ..... 34/212
4,145,820 A * 3/1979 Fehlhaber et al. ..... 34/75
4,207,356 A * 6/1980 Waugh ..... 427/521
4,268,975 A * 5/1981 Schall et al. ..... 34/105
4,270,283 A * 6/1981 Ellis ..... 34/212
4,288,650 A * 9/1981 Robinson ..... 373/22
4,295,826 A 10/1981 Vasilantone
4,355,507 A * 10/1982 Coffey et al. ..... 60/39.5
4,398,700 A * 8/1983 Thome ..... 266/111
4,517,448 A * 5/1985 Crain et al. ..... 219/388
4,597,242 A * 7/1986 Hendriks et al. ..... 53/426
4,599,809 A * 7/1986 Parkes ..... 34/484
4,674,475 A * 6/1987 Powis ..... 126/110 C
4,693,052 A * 9/1987 Rebmann et al. ..... 53/167
4,750,273 A * 6/1988 Parkes et al. ..... 34/484
4,784,110 A * 11/1988 Skafte et al. ..... 126/110 AA
5,022,165 A * 6/1991 Beswick ..... 34/62
5,078,368 A * 1/1992 Hemsath ..... 266/236
5,083,870 A * 1/1992 Sindelar et al. ..... 366/25
5,129,212 A * 7/1992 Duffey et al. ..... 53/426
5,211,992 A * 5/1993 Newton et al. ..... 427/512
5,303,999 A * 4/1994 Nath et al. ..... 366/25
5,322,367 A * 6/1994 Nath et al. ..... 366/7
5,344,229 A * 9/1994 Nath et al. ..... 366/25
5,385,611 A * 1/1995 Matsumoto et al. ..... 118/642
5,534,222 A * 7/1996 Kelbrick et al. ..... 422/33
5,650,693 A * 7/1997 Campbell et al. ..... 315/111.21
5,658,619 A 8/1997 Kirschner et al.
5,683,241 A * 11/1997 Casselman ..... 432/97
5,964,043 A * 10/1999 Oughton et al. ..... 34/92
6,209,591 B1 * 4/2001 Taggart ..... 141/89
6,287,111 B1 * 9/2001 Gensler ..... 432/170
6,351,924 B1 * 3/2002 Gustafsson et al. ..... 53/425
6,475,435 B1 * 11/2002 Taggart ..... 422/33
6,684,527 B1 * 2/2004 Wise ..... 34/418
6,767,406 B2 * 7/2004 Vitale ..... 118/421
7,018,201 B1 * 3/2006 Pierce et al. ..... 432/128
7,187,856 B2 * 3/2007 Atkins ..... 392/484
7,267,793 B2 * 9/2007 Poor et al. ..... 266/250
7,571,585 B2 * 8/2009 Till ..... 53/167
7,685,794 B2 * 3/2010 Nagatani et al. ..... 53/425
2003/0167652 A1 * 9/2003 Takagi ..... 34/60
2005/0120715 A1 * 6/2005 Labrador ..... 60/618
2006/0040063 A1 * 2/2006 Zoppas et al. ..... 427/430.1
2008/0155985 A1 * 7/2008 Labrador ..... 60/698
2008/0222912 A1 * 9/2008 Hahn ..... 34/437
2009/0094853 A1 * 4/2009 Noyes et al. ..... 34/233

FOREIGN PATENT DOCUMENTS

JP 56033423 A * 4/1981
JP 63118507 A * 5/1988
JP 2003300718 A * 10/2003

* cited by examiner

PROCESS AND DEVICE FOR TREATING THE COATING OF THERMOPLASTIC RESIN CONTAINERS

TECHNICAL FIELD

This invention relates to a process, and the relating device, for treating the coating of containers. More particularly, it relates to a process, and the relating device, for drying protective coatings on containers, especially bottles made of thermoplastic resin.

BACKGROUND ART

Thermoplastic materials, such as PET (polyethylene terephthalate), have been used for some time now to make containers. This is particularly true for food-containing containers, especially drinks. Although said containers can be of different types, they shall be referred to hereinafter generically as bottles, which happen to be the most spread.

Bottles made of thermoplastic materials are definitely convenient in terms of weight, resistance to impact, cost, and similar but also have some drawbacks. For example, said materials are somewhat microporous making, along with the limited thickness of the wall, the bottle permeable to gas. For example, oxygen may penetrate into the bottle modifying the contents through oxidation, and/or carbon dioxide found in many carbonated drinks may escape making the drink less fizzy and attractive.

Many solutions have been put forward to resolve these problems. Firstly, one solution involves increasing the thickness of the bottle wall; unfortunately, this increases production costs and can lead to problems during manufacturing. Secondly, one solution involves using multilayer bottles; however, this increases production costs and complexity. Thirdly, another solution entails depositing a thin layer to act as barrier on the internal wall of the bottles; unfortunately, this also increases costs and complexity.

An apparently simple and effective solution exists to the problem of creating a protective coating capable of acting as barrier to gas exchanges: painting, especially through dipping, the external surface of the bottles.

For example, patent U.S. Pat. No. 5,658,619 describes a process for coating bottles. This process involves sending bottles to a coating segment where the bottles are gripped and dipped one at a time in one of many containers filled with a coating solution consisting of a resin dispersed in a solvent. Then, after removing the bottles from the coating solution, the bottles are released and sent to a flash-off segment where the solvent of the coating solution is removed from the coating applied to the outer surface of the bottle. After the flash-off process, the bottles are sent to a reticulation station where the resin of the coating is reticulated.

Such a plant is complex and has a few critical points, especially regarding the formation of paint sagging in the detearing phase, during the transfer from the painting station to the flash-off station. Furthermore, eliminating the solvent found in the paint through simple flash-off is a long process that is not well controlled.

Sometimes paints with a water-based solvent are used to reduce costs and limit environmental pollution. Unfortunately, this option hampers drying, requiring long drying times or heating of the bottles at a temperature apt to promote the quick elimination of the solvent. If high outputs are required, said temperature is very near to, if not greater than, the temperature for softening the thermoplastic material of the bottles.

Hence, it is very important to provide a paint-drying system that limits any damage to the bottles and, at the same time, assures treatment methods and limited drying times, after painting, that prevent irregularities in the thickness of the coating.

A simple way of drying said water-based paints is to heat them; for example, by exposing them to infrared radiation (IR).

An infrared-heating plant is described, for example, in patent application PCT/EP00/10540, of this Applicant, although it refers to a plant for conditioning pre-moulded workpieces to be sent to final moulding, meaning that it is used to raise the temperature of said workpieces to one suitable for final moulding. In the aforementioned document, the pre-moulds are conveyed past a series of IR lamps; at the same time, an adjustable airflow at ambient temperature flows, first, around the pre-moulds and, then, around the IR lamps to cool them.

Although this solution is appealing, it concerns non-painted pre-moulds, which must simply be heated at an established temperature using different handling methods and short heating times.

OBJECTS OF THE INVENTION

It is an object of this invention to provide a process for drying perfectly a protective layer placed on containers, especially bottles, made of thermoplastic material in order to decrease the permeability of the bottle to gas, which could affect the quality of the contents of the bottle if gas seeps into or out of the bottle.

It is another object of the invention to provide a process for drying the protective layer placed on containers, especially bottles, made of thermoplastic material without overheating the thermoplastic material, which could distort the bottles, and wasting energy.

It is an additional object of the invention to provide a plant for carrying out the aforementioned process.

These and other advantages of the invention shall be readily apparent from the detailed description of the currently preferred embodiments of the invention, given as nonlimiting examples that do not exclude further embodiments and improvements.

DESCRIPTION OF THE INVENTION

This invention refers to a process whereby bottles, which are made of thermoplastic material and held by their aperture by means of evenly distributed specific gripping devices, are dipped into a resin solution in a solvent, which is later evaporated through the flash-off method, in order to place a protective layer on the outer surface of the bottles. The drying process described in this invention comprises the following steps:

i. Feeding the coated bottles, after removing the excess resin solution employing a known method, through a first area of the treatment furnace located under spaced out heating elements;

ii. Allowing air to flow from outside the treatment furnace into said first area of the furnace; specifically, the air must flow upward, first, around the bottles and, then, around said heating elements;

iii. Sending said bottles, after feeding them under the heating elements, into a second area of the furnace, which is located above said heating elements;

iv. Allowing the airflow, which has already flown around said heating elements, to flow around the bottles in said second area;

v. Mixing at least part of the hot airflow flowing out of said second area with air obtained from outside before sending a refreshed airflow to said first area of the furnace.

Inside the drying furnace, both in the first and second areas, the bottles are positioned horizontally.

The above process is further characterized by the fact that the radiation emitted upward by the heating elements is reflected on the bottles by means of a reflecting device. This reflecting device also lets the airflow that flowed past the heating elements into said second area; in fact, the device is suitably perforated uniformly on 10-30% of its surface (preferably, 15-25%).

The heating elements have an elongated shape and many infrared lamps (IR), preferably arranged in several distinct clusters. The major axis of these heating elements is positioned horizontally.

The temperature of the airflow that brushes against the bottles being fed under the heating elements ranges from 50 to 70° C., and the speed of the airflow flowing around the bottles is between 1.5 and 2.5 m/s; these parameters are controlled so that the temperature of the bottles passing beneath the heating elements is never greater than 65° C.

Then, the airflow, which has been warmed up (to reach a temperature approximately between 60 and 80° C.) by the heating elements, flows (at a speed ranging from 1.5 to 2.5 m/s) around the already treated bottles in the second area of the furnace above the heating elements so that the temperature of the bottles does not exceed 65° C.

The relevant parameters (power emitted by the lamps, airflow, bottle treatment time, and air circulation % in the furnace) are all adjusted so that 75 to 95% of the solvent (ideally 85 to 92%) is removed from the coating through infrared heating in the first area of the furnace, while the remaining amount of solvent is removed through hot air in the second area of the furnace.

In this manner, i.e. by removing only part of the solvent from the coating in the first area of the furnace, it is possible to control very well the temperature of the bottles under the heating elements, minimizing distortions of the bottle wall and resin crystallization.

As was already mentioned, the hot air coming from the first area of the furnace is utilized again in order to remove any residual solvent from the coating in the second area of the furnace, minimizing wasted energy. Furthermore, the air flowing out of said second area is sent back, at least partially, to the first area of the furnace; thus, not only does this further conserve energy but it also helps maintain the desired temperature in said first and second areas of the furnace, promoting excellent process steadiness regardless of ambient temperature.

In addition, part of the cold air drawn from outside the furnace is diverted, before entering the first area of the furnace, in order to maintain the neck of the bottles at a temperature of 55° C. at most.

The bottles are kept in the horizontal position throughout the drying process, and, at least in the infrared furnace, the bottles rotate at a speed between 100 and 300 revolutions per minute.

The infrared lamps are of the medium wave type; the time the bottles take to pass in front of the lamps is included between 15 and 30 sec, preferably 25 sec.

A particular embodiment of the invention shall be described below. This version is given as a nonlimiting example of the scope and scale of the invention, and in conjunction with the following accompanying drawings:

FIG. 1 shows the basic cell of the plant in accordance with the invention.

Figure 1:
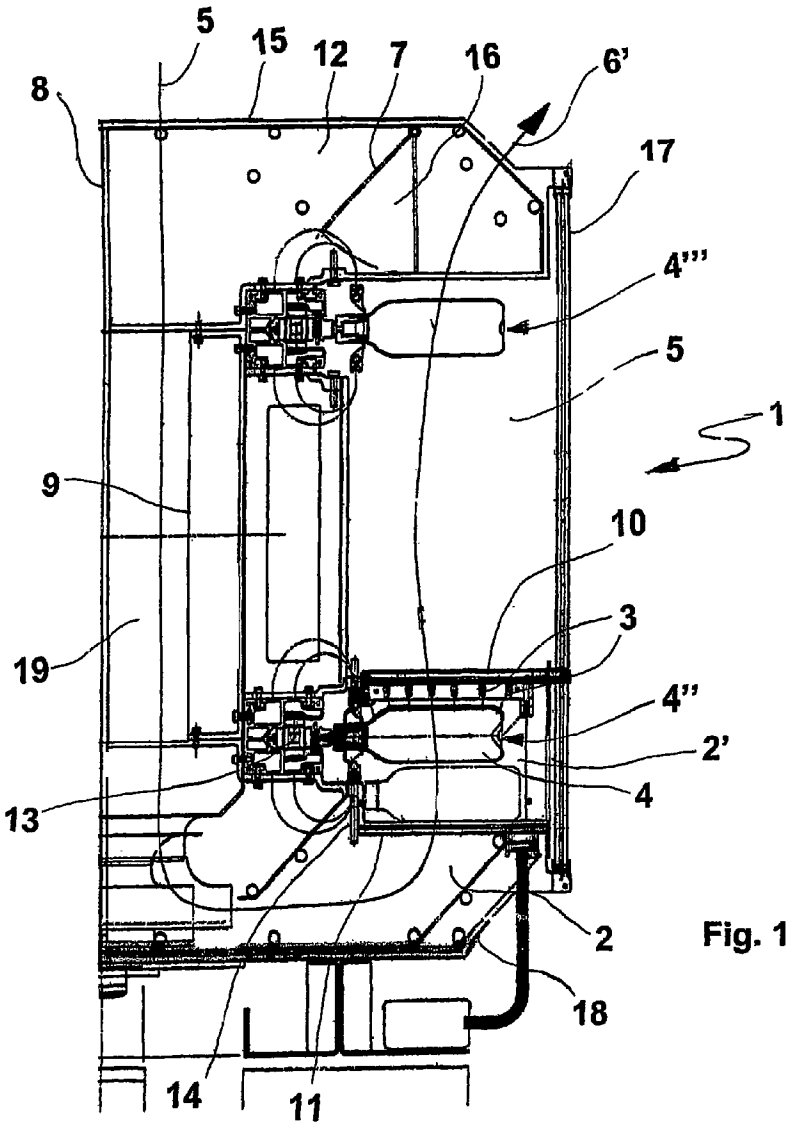
FIG. 1 shows a vertical cross section of a first embodiment of the plant.

It consists of a chamber (1) delimited by walls (8,15, 17, and 18), comprising the following elements:

i. A first lower area (2) for treating bottles (4), and a second upper area (5) for treating bottles ii. A furnace (2') found inside the lower area (2) equipped with heating elements (3) (for example, infrared lamps) suitable to emit thermal radiation; this furnace is delimited by a wall (14), part of the outer wall (17), an upper wall (10), and a lower wall (11)—both suitable to reflect the thermal radiation and allow gas to flow through;

iii. Known means (not shown in the figures) suitable to create a flow of ambient air (6) and to control the flow rate;

iv. A chamber (12) suitable to receive said airflow (6); this chamber is delimited by walls (8, 15) and by a door (7) communicating with a vertical duct (19), which is delimited by a wall (8) and an element (9) that in turn communicates with said lower area (2);

v. A chain having many gripping devices (13) that grip and hold the bottles, the so-called chucks, in the furnace (2'); said chain passes outside the furnace parallel to a wall (14) equipped with an opening apt to enable the passage of the neck of the bottles, making it possible to keep the neck of the bottles outside the furnace (2') and divide the airflow (6).

During the process, the bottles (4) enter the furnace (2') near the lamps in a specific position (position 4"), move through the entire furnace in said position, exit the furnace, move upward, and are placed in a specific position (4'''). Meanwhile, an airflow (6), which is created and controlled by devices not shown in the figure, flows from the chamber (12) into the lower area (2) through a duct (19). Once the airflow reaches said area, it is divided by a wall (14) into two parts: a first airflow goes through a wall (11) in order to enter the furnace (2'), control the temperature of the bottles, and cool the devices that emit thermal radiation or heating elements (3); a second airflow flows upward in order to exit the furnace (2') brushing against a wall (14) in order to keep the neck of the bottles (4) held in the chucks (13) cool. The first part of the airflow, after cooling the heating elements (3), goes through a wall (10) and flows upward to the upper part of the chamber (1) where it brushes against the bottles in position 4''', finishing off the paint-drying process, and then flows into the escape chamber (16). In this chamber, the hot airflow is at least partially sent back into chamber 12 through a door (7) in order to regenerate heat and keep the temperature of the furnace (2') constant.

Figure 2:
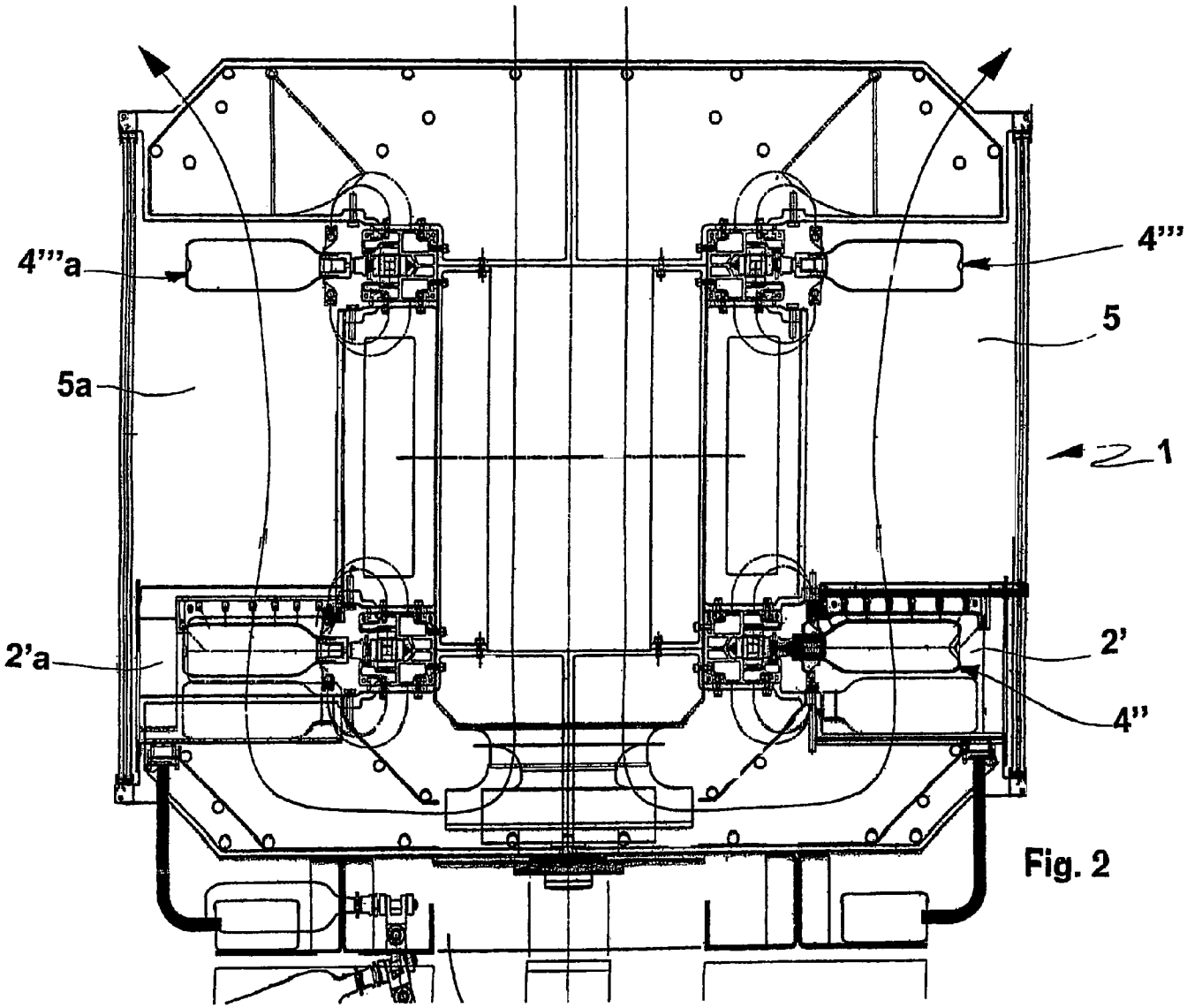
FIG. 2 shows a vertical cross section of a second embodiment of the plant.

If there is not enough space lengthwise to handle the required output, instead of the in-line layout, the two segments of the plant can be placed side by side (see FIG. 2 where all the parts are numbered exactly like in FIG. 1). In this version of the invention, the bottles move along the following path (refer to drawing): starting on the right-hand side, the bottles enter the chamber (1) in position 4", travel through the furnace (2') in the direction of the viewer, turn left to enter furnace 2'*a* on the left part of the plant moving away from the viewer; now, they move upward in position 4'''*a*, travel across the upper area (5*a*) of the left part of the plant moving toward the viewer again, turn right, and finally enter in position 4''' in part 5 that they travel across moving away from the viewer toward the exit of the drying plant.

The invention claimed is:

1. A device for treating the coating of bottles made of thermoplastic material consisting of a chamber having a first, a second, a third and a fourth delimited walls comprising the following elements:

i. A first lower area for treating bottles, and a second upper area for treating bottles;

ii. A furnace placed inside the lower area equipped with heating elements suitable to emit thermal radiation; this furnace is delimited by a wall, part of the third delimited wall, an upper wall, and a lower wall—both suitable to reflect the thermal radiation and allow gas to flow through;

iii. Means suitable to create a flow of ambient air (6) and to control the flow rate;

iv. An inlet chamber suitable to receive said airflow; delimited by the first and second delimited walls and by a door communicating with a vertical duct, which is delimited by the first delimited wall and an element that in turn communicates with said lower area to permit air flow from the chamber to said area;

v. A chain having a plurality of chucks that grip and hold the bottles in the furnace when in proximity of the furnace and passing outside of it parallely to the wall provided with an opening adapted to allow the passage of the neck of the bottles, making it possible to keep the neck of the bottles outside the furnace and to divide the airflow.

2. A device as claimed in claim 1 wherein the door separates the inlet chamber of the air from an outlet chamber from which the air, after passing from the lower area to the upper area and being heated by the heating elements, flows out of the chamber, said door being adapted to be operated to inlet part of the hot air flowing out of the outlet chamber into the inlet chamber.

3. A device as claimed in claim 1 wherein said wall also serves to deflect part of the airflow coming from the duct to area to send it to the chucks to cool the neck of the bottles.

* * * * *